US005303899A

United States Patent [19]

Palya

[11] Patent Number: 5,303,899

[45] Date of Patent: Apr. 19, 1994

[54] APPARATUS FOR LIFTING CONSTRUCTION ELEMENTS

[76] Inventor: Jerome C. Palya, 3670 Glen Echo Ct., Reno, Nev. 89509

[21] Appl. No.: 709,494

[22] Filed: Jun. 3, 1991

[51] Int. Cl.[5] ..... B66D 1/36; E04G 21/14

[52] U.S. Cl. ..... 254/334; 414/11

[58] Field of Search ..... 254/324, 325, 326, 334, 254/335; 294/67.2, 65, 74; 414/10, 11, 627, 745.1

[56] References Cited

U.S. PATENT DOCUMENTS

| | | | |
|---|---|---|---|
| 734,019 | 7/1903 | Van Tuyl | 254/334 |
| 2,443,349 | 6/1948 | Foster | 414/11 |
| 2,672,319 | 3/1954 | Nelson | 414/10 |
| 3,361,280 | 1/1968 | Traver | 414/627 |
| 3,382,988 | 5/1968 | O'Reilly | 414/11 |
| 3,765,550 | 10/1973 | Taucheck | 414/11 X |
| 3,840,262 | 10/1974 | Foster et al. | 294/74 |
| 4,023,686 | 5/1977 | Papsco et al. | 414/11 |
| 4,696,613 | 9/1987 | Hahn | 294/65 X |
| 4,860,404 | 8/1989 | Flachs | 254/334 X |
| 4,915,434 | 4/1990 | Dolezych et al. | 294/74 |

FOREIGN PATENT DOCUMENTS

| | | | |
|---|---|---|---|
| 8540 | 2/1956 | Fed. Rep. of Germany | 254/334 |

*Primary Examiner*—Daniel P. Stodola
*Assistant Examiner*—Michael R. Mansen
*Attorney, Agent, or Firm*—Herbert C. Schulze

[57] ABSTRACT

A device for lifting panels and other construction materials wherein a single individual may cause such panels or the like to be elevated vertically in connection with a structure to a location considerably a higher location than that which the person performing the operation is located, and without the use of ladders or the like, wherein a frame is provided which can be mounted vertically and erected vertically and a panel or the like slides upwardly by a winch operation until in position for securing to the structure. And a provision for legs to be established to attach to said frame by which a work table may be provided to work on such panels or the like prior to their installation.

1 Claim, 3 Drawing Sheets 62
52
60
50
56
64
10
54
58
74
106
58
112
24
26
12
202
28
18
104
76
112
78
29
86
82
80
84
70
68
66
72
22
40
34a
34
16
38
36
14
20
110
102
42
112
32
108
48
46
100
48
44

16
74
96
92
98
90
12
14
94

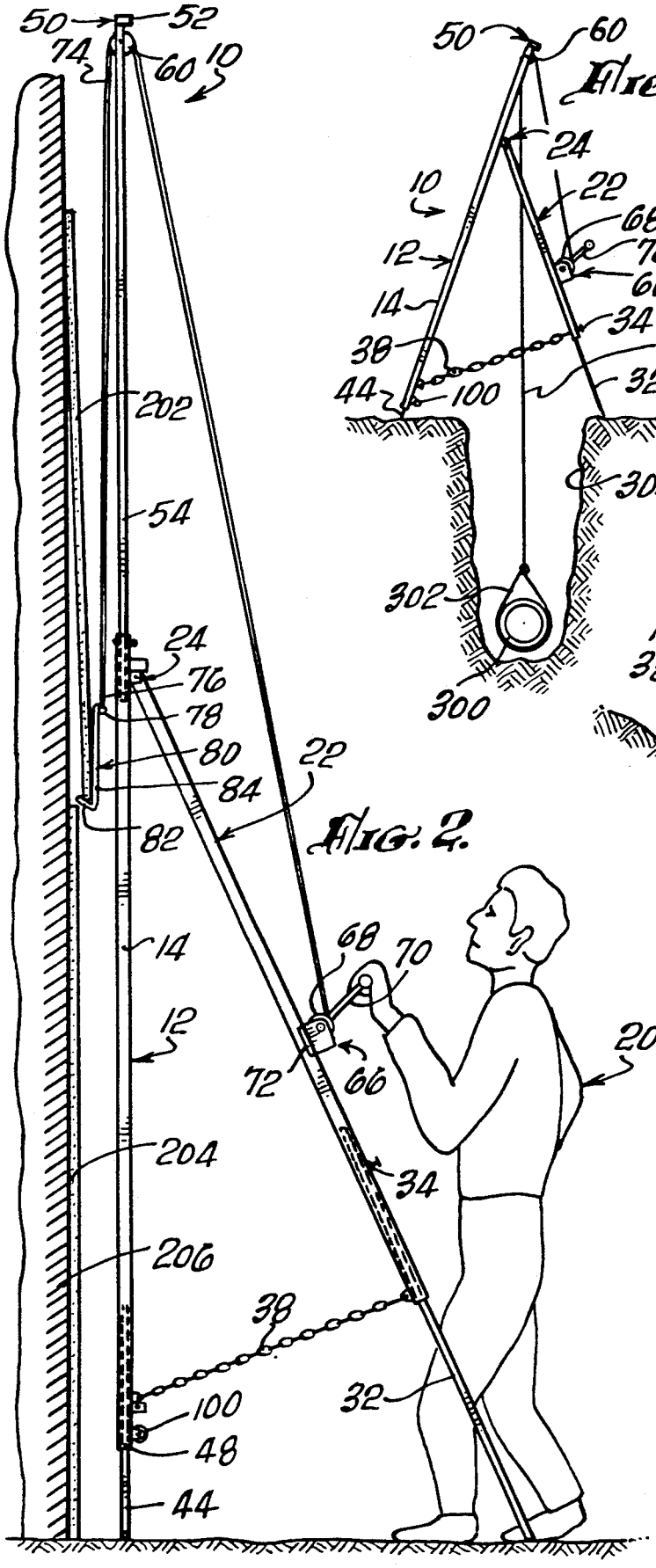
FIG. 2.
FIG. 3.
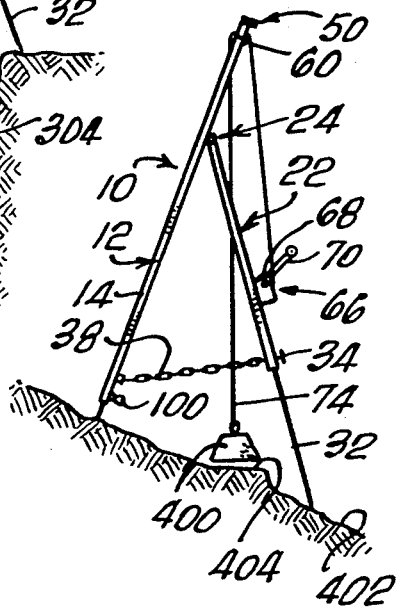
FIG. 4.

APPARATUS FOR LIFTING CONSTRUCTION ELEMENTS

CROSS REFERENCE TO RELATED PATENT APPLICATIONS

There are no other patent applications related to this application filed by me.

BACKGROUND OF THE INVENTION

1. Field of the Invention

This invention is in the general field of lifting objects such as panels of construction material, and the like, and other objects of heavy weight such as plates of glass.

The invention is even more particularly directed to a method and apparatus for raising such objects to heights above the reach of a person, or having difficult size and weight characteristics.

This invention is even more particularly directed to an easily transportable lifting device suitable to practice the method of this invention, which may also be converted to a convenient, on the spot, work bench.

2. Description of the Prior Art

There is no prior art in this field known to me. In the past it has been customary for more than one person, utilizing ladders, or the like, to transport and lift heavy and awkward panels and the like.

SUMMARY OF THE INVENTION

Construction, repair, and replacement in connection with structures frequently requires the placing, within, or upon, such structure large elements such as wall panels, window plate glass, and the like. These elements will normally be delivered to a job site in the customary manner by truck, or the like. Persons working at the job site must then place such elements onto the appropriate portion of the structure. In the case of large wall panels, glass, and the like which must be lifted to an elevated location, it is normally necessary for a multiplicity of persons to climb on ladders, or the like, and place the elements in proper position for permanent installation.

I have studied the field of construction, particularly in connection with the lifting and placement of large panel elements and the like and have been thoroughly familiar with great problems including economic and safety problems.

When two or more persons are attempting to handle a large panel especially placing it into an elevated position there are inherent dangers, a considerable loss of time, and all of the attendant economic factors. Up until now there has not been a method or an apparatus by which one man could economically, conveniently, safely, and easily place large panels and the like in the appropriate position for permanent installation.

I have now conceived and completely developed a method and apparatus such that a single work person can safely and economically install large heavy and awkward panels and the like.

The method I have developed utilizes a light weight, portable lifting and handling device having adjustable extension legs, appropriate wheels for easy transportation, telescoping lift assembly, and panel holding elements.

Frequently, it is necessary to do work on such panels, or install appurtenances, and the like. This always presents a great problem since usually there are not good facilities for maintaining such items in a stable horizontal position while doing the necessary work. I have, therefore, incorporated means to convert the lifting device to a horizontal work bench suitable to accommodate uneven terrain at a work place and yet maintain a panel or the like in a proper horizontal position.

It is an object of this invention to provide a method and apparatus for transporting, and elevating, large panels and the like in connection with ultimate installation of such items on a structure.

Another object of this invention is to provide a method and apparatus for safely lifting panels and the like;

Another object of this invention is to provide a method and apparatus for properly leveling the lifting device so as to accomplish a proper vertical lifting without danger of tipping;

Another object of this invention is to provide the apparatus heretofore described wherein the apparatus may be converted into a work bench for working on materials at the site.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 2 is a simplified side elevation of the apparatus of FIG. 1 showing an operator actuating the winch assembly to lift a panel to a higher elevation for placement against a wall surface;

FIG. 3 is a schematic side elevation of the lifting apparatus of FIG. 1, modified, placing a pipe, or the like, into position in a trench;

FIG. 4 is a simplified side elevation of the apparatus of FIG. 1 showing a method of supporting and placing an object on a sloped surface;

DESCRIPTION OF A PREFERRED EMBODIMENT

Figure 1:
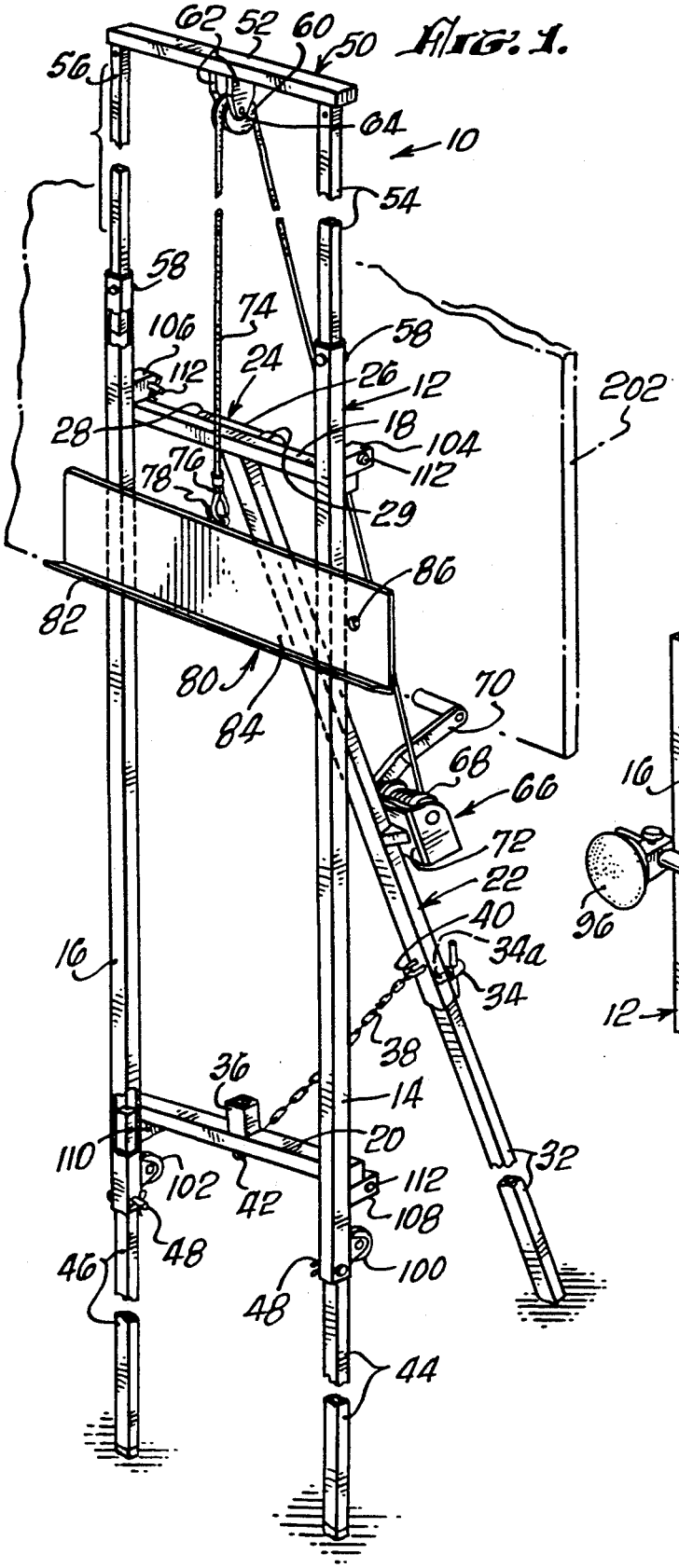
FIG. 1 is a perspective, with portions broken away, of an apparatus suitable to practice the method of this invention, showing a panel in phantom lines being lifted.

Illustrated in FIGS. 1 and 2, an apparatus 10, generally, is in an upright condition and in the process of lifting a panel to a height above the normal reach of a worker.

The apparatus is shown with a central frame member 12 having rectangular tubular posts 14 and 16. These posts are fabricated with upper and lower crossbars 18 and 20 by weldment, or the like.

Pivotally connected to upper crossbar 18 is a rectangular tubular leg member 22. The pivot 24, generally, comprises a short hollow cylindrical tube 26 mounted between union members 28 and 29. The members 28 and 29 are affixed to the upper crossbar 18 by weldment, or the like, and support a pin 30. This pin 30 acts as a pivot pin for allowing movement of the leg 22 about its axis.

A rectangular elongated foot member 32 is adjustably mounted within leg 22. This foot member 22 may be extended as necessary to rest on the base surface when leg 22 is pivoted outwardly from the balance of the frame. Such movement of leg 22 allows the entire assembly 10 to remain in a upright position for installation of panels and the like. A fastening screw 34, or the like inserted into threaded opening 34*a*, secures the foot member from moving once it is in appropriate installation position. Member 36 is provided so that when the leg and foot 22–32 is not in use as shown in FIG. 1 it may be held in this position by inserting extension 32 into the member 36. A chain 38 or the like fastened at 42 to crossbar 20 and at 34*a* to member 22 may be used to limit the ultimate travel of leg and foot 22–32. Slidable extensions 44 and 46 are provided within frame members 14 and 16 respectively for extension, depending upon surface conditions, so as to be able to maintain a proper level position during any lifting operation. Pin and spring clip assembly 48 are shown with the ends of the elements 14 and 16 to provide locking assemblies by insertion through holes (not shown) in the extension bars 44 and 46. A plurality of such holes allows extension to a fixed position as may be required by base surface conditions. The term "base surface" as used herein means the working surface, whether it be a floor, a ramp, ordinary ground conditions, or the like, upon which persons are standing and working and upon which the apparatus of this invention is placed for use in lifting panels and the like.

In order to create a lift apparatus to bring panels, and the like, to higher locations, an upper extension assembly is shown in FIGS. 1 and 2 at 50, generally. This upper extension assembly comprises a topmost crossbar member 52 which is affixed to elongated rectangular extensions 54 and 56. These extensions slide within the upper ends of posts 14 and 16 and pass through the open ends at these locations. Locking assemblies 58 are provided at these upper ends of the posts. As previously described, holes within the posts and the extensions 54 and 56 allow positive locking between the two components in extended and collapsed positions.

A pulley 60 is shown mounted between two extension plates 62. These plates are fastened to the underside of the uppermost crossbar member 52 and are provided with a pin 64 for rotatably supporting the pulley 60.

A winch assembly 66, having a line reel 68 is actuated for rotation by a handle 70 mounted on a bracket assembly 72 which is affixed to the tubular leg 22 on the outer surface thereof. A cable of steel, nylon, hemp, or other suitable material is provided at 74.

The cable 74, wound upon the reel 68, passes over pulley 60 to a connector 76. Connector 76 is removably fastened to an eye member 78 affixed to the panel lifter plate 80.

The panel lifter plate is formed with a lip 82 to support a panel against slipping from the back portion of plate 84. An opening 86 is shown formed on the back portion 84 of the lifter plate in order to provide for lock screw member 88 (as shown in FIG. 6 of the drawings) to pass therethrough into a threaded opening 88*a* on the underside of leg 22.

Figure 1A:
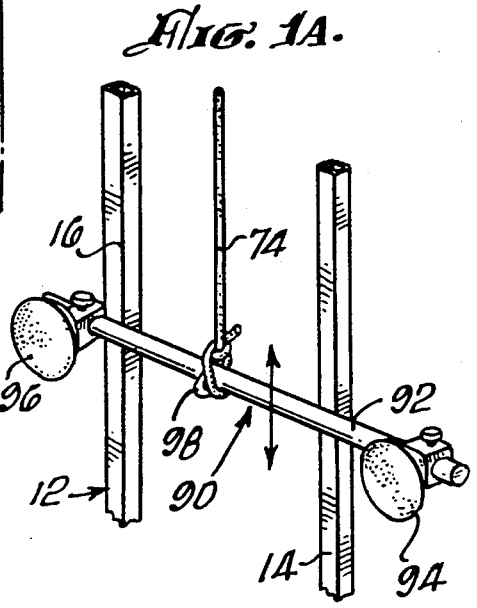
FIG. 1A is a fragmentary perspective of the apparatus of FIG. 1 being adapted to a plate glass supporting device.

Turning attention to FIG. 1A of the drawings, it can be seen that in order to convert the lift assembly to be able to lift large plates of glass, and the like, it is deemed necessary to attach an assembly 90 to the cable. A suction cup holder bar 92 with suction cup assemblies 94 and 96 is shown secured at 98 to cable 74. The holder bar 92 slides against the posts 14 and 16 for ease in transporting a plate glass, or the like.

A set of wheel assemblies is provided at 100 and 102. By collapsing the leg extensions 44 and 46, the operator can place an element to be installed on a structure upon the panel lift member and then can wheel the lift assembly to the position where it is desired to lift the panel. In this manner the lift assembly will be acting somewhat like a hand truck. However it is different from a hand truck in that the panel lifting member will give added support to a panel making it much more stable for this purpose, particularly where large and clumsy panels are being utilized. The unit itself may be wheeled to a job site, without a panel in position in a similar manner.

Figures 5, 6, 7:
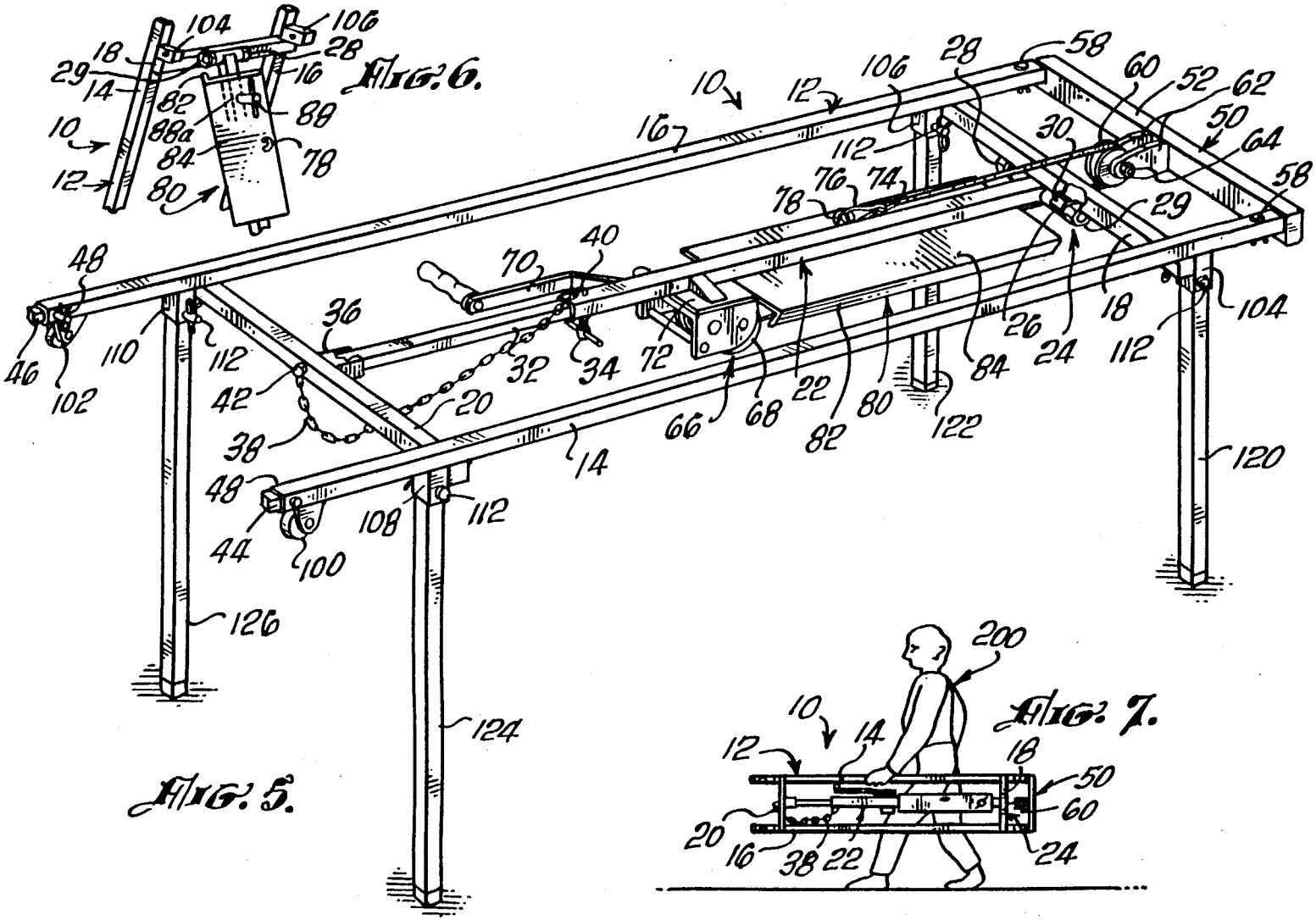
FIG. 5 is a perspective, partially broken away, of a work table formed from the lifting apparatus as modified.
FIG. 6 is an underside, fragmentary, perspective of a portion of the apparatus of FIG. 1 illustrating a manner for storage of a lifting plate member when not in actual use.
FIG. 7 is a side elevation, in reduced scale, of a person carrying the apparatus of FIG. 1, collapsed.

In some instances, it will be desired to completely collapse the total assembly as shown in the illustration of FIG. 7. In this instance, a person 200, utilizing the device, can carry the entire collapsed item. This is particularly convenient where it is necessary to go upstairs or on difficult terrain to reach the point of use.

By providing short tubular segments 104, 106, 108 and 110 to the undersides of posts 14 and 16, it can be seen that by using locking assemblies 112, table legs 120, 122, 124 and 126 can be attached to central frame 12. FIG. 5 illustrates the manner in which, after the plate 84 is secured for storage, that the assembly can be used to support panels, and the like, at a job site. This will be most helpful where it is necessary to safely and conveniently support a panel in a horizontal position for purpose of applying various appurtenances to the panel, as may frequently be of applying various required with construction elements.

Referring to FIG. 2 in particular it can be seen that the operator can place a construction panel 202 onto the lift plate 80 and operate the winch and lift it to a height which is above an already installed construction panel 204 on wall 206. The winch will be of customary winch construction and may be of the type known as a "soft release" winch. These winches are well known to those familiar with the art and may be purchased "off the shelf" in a customary manner.

The many uses of this lift assembly can be readily illustrated in the two examples of FIGS. 3 and 4.

FIG. 3, in particular, illustrates that the lift assembly 10 can be placed over a trench 304 and an operator can lower and properly place a pipe, or the like shown at 300 and with the aid of a sling 302 can easily accomplish such a task on the job site.

FIG. 4, shows the lift assembly 10 being placed on a sloping surface 402 and is shown supporting and placing a load, such as a foundation pier, or the like 400, onto a prepared surface 404.

Other uses of the lift assembly, along with its winch, may be pulling telephone and electrical cables through conduit, and the like. The lift assembly can also lift highway signs, and the like onto their mounting supports, and the like.

While the embodiments of this invention shown and described are fully capable of achieving the objects and advantages desired, it is to be understood that such embodiments are for the purpose of illustration only and not for the purposes of limitation.

I claim:

1. The apparatus for lifting construction elements comprising: a first elongated tubular frame member; a second elongated tubular frame member parallel to and at a spaced distance from said first tubular frame member; a first crossbar perpendicular to said tubular frame members and fastened at a first end to the first tubular frame member and fastened at a second end to the second tubular frame member; a second cross bar parallel to said first cross bar at a spaced distance therefrom and fastened at a first end to said first tubular frame member and fastened at a second end to the second tubular frame member; a first leg socket fastened to said first tubular frame member perpendicular to said first and second tubular frame members and said first and second crossbars; a second leg socket fastened to said first tubular frame member perpendicular to said first and second tubular frame members and said first and second crossbars and at a spaced distance from said first leg socket; a third leg socket fastened to said second tubular frame member perpendicular to said first and second tubular frame members and said first and second crossbars; a fourth leg socket fastened to said first tubular frame member perpendicular to said first and second tubular frame members and said first and second crossbars and at a spaced distance from said third leg socket; four support legs, one of which is removably mounted within each leg socket; a tubular leg pivotally fastened at a first end to the first cross bar at an equal distance from each of said tubular frame members and between them and detachably held at a second end by said second crossbar at an equal distance from each of the tubular frame members; a first telescoping member slidably mounted within said first tubular frame member at its second end; a second telescoping member slidably mounted within said second tubular frame member at its second end; a third telescoping member slidably mounted within said tubular leg at its second end; a first telescoping pulley support member slidably mounted with said first tubular frame member at its first end; a second telescoping pulley support member slidably mounted with said second tubular frame member at its first end; a third cross bar connected at a first end to a first end of said first pulley support member and at a second end to a first end of said second pulley support member in such manner that the third crossbar is exterior of the first ends of said tubular frame members when the pulley support members are telescoped within the frame members; pulley means suitable to carry a cable, fastened to the third cross bar at a position equally distant from its first and second ends and depending in a direction parallel said pulley support members; winch means suitable to impart movement to a cable carried by said pulley means fastened to said tubular leg at a position intermediate its first and second ends; construction element carrying means removably carried by the tubular leg; and cable means suitable to be used to impart movement to said construction element carrying means passing over said pulley means and fastened at a first end to said winch means and at a second end to said construction element carrying means; first wheel means fastened to said first tubular frame member adjacent its second end; and second wheel means fastened to said second tubular frame member adjacent its second end said first and second wheel means being suitable to support the entire apparatus upon and roll over a base support surface.

* * * * *